166-307
6/2/81 XR 4,270,609 SR

United States Patent [19]

Choules

[11] 4,270,609

[45] Jun. 2, 1981

[54] TAR SAND EXTRACTION PROCESS

[76] Inventor: G. Lew Choules, 1095 S. McClelland St., Salt Lake City, Utah 84105

[21] Appl. No.: 74,868

[22] Filed: Sep. 12, 1979

[51] Int. Cl.[2] ..... E21B 43/24; E21B 43/27; C10G 1/00

[52] U.S. Cl. ..... 166/303; 166/272; 166/307; 208/11 LE

[58] Field of Search ..... 166/271, 272, 302, 303, 166/305 R, 307, 304; 208/11 R, 11 LE; 210/730 W

[56] References Cited

U.S. PATENT DOCUMENTS

| | | | |
|---|---|---|---|
| 1,497,607 | 6/1924 | Streppel | 208/11 LE |
| 1,791,797 | 2/1931 | Clark | 208/11 LE |
| 3,221,813 | 12/1965 | Closmann et al. | 166/271 |
| 3,330,757 | 7/1967 | Bichard | 208/11 LE |
| 3,331,765 | 7/1967 | Canevari et al. | 208/11 LE |
| 3,556,982 | 1/1971 | Kaminsky et al. | 208/11 LE |
| 3,858,654 | 1/1975 | Walker | 166/272 X |
| 4,019,578 | 4/1977 | Terry et al. | 166/272 X |
| 4,033,412 | 7/1977 | Barrett | 166/305 R X |
| 4,034,812 | 7/1977 | Widmyer | 166/303 |

*Primary Examiner*—James A. Leppink
*Assistant Examiner*—George A. Suchfield
*Attorney, Agent, or Firm*—Thorpe, North, Western & Gold

[57] ABSTRACT

A method for separating and recovering bitumen from tar sand and other viscous petroleum deposits, either in situ or after mining the deposits. The method may also apply to heavy oil wells and to secondary and tertiary recovery of oils from wells. The tar sand is heated in an aqueous mixture of floating agent containing ammonia, a transfer agent containing a phosphate or silicate ion and a strong monovalent base. The bitumen rises to the surface of the mixture, without foaming or appreciable emulsification and will stay at the surface after cooling. Nearly clean sand remains in the bottom. Both an in situ separation technique and a process for recovering bitumen from mined tar sand are described using the aqueous mixture.

18 Claims, 2 Drawing Figures

TAR SAND EXTRACTION PROCESS

BACKGROUND OF THE INVENTION

This invention applies generally to the recovery of viscous petroleum from natural formations. More specifically this invention relates to a process for separating bitumen from tar sands. While tar sand formations are specifically discussed here, it is well to consider that the technology described herein will also apply to viscous oil deposits, and to secondary or tertiary recovery processes after primary oil recovery. In other words, the invention is generally valuable for use on petroleum formations where problems of high viscosity and/or surface adhesion exist.

There are an estimated 26 billion barrels of tar of heavy oil in the tar sand deposits of Utah, but very little development of these deposits has occurred. These are rich deposits containing 8 to 14 percent bitumen, but they are more resistant to aqueous solution recovery techniques than are the Athabaska tar sands in Canada. U.S. Pat. No. 3,858,654 and Canadian Pat. No. 1,027,889 both teach processes for extracting tar from tar sands utilizing a combination of a polyphosphate compound combined with an alkalinity agent such as an ammonium or alkali metal hydroxide. Unfortunately, these methods provide relatively small yields when applied to Utah tar sands. For example, high concentrations of sodium pyrophosphate (20–30%) and sodium hydroxide (5%) give only partial separation of the bitumen from a Utah tar sand, even after boiling for extended periods. Clearly an improved method of recovery applicable to Utah tar sands would be of great economic importance. This is primarily the object of the present invention; however the method claimed herein will apply equally well to the Athabaska and other tar sand deposits throughout the world.

BRIEF SUMMARY OF THE INVENTION

It has been discovered that bitumen can be effectively separated from tar sands when the tar sand is heated and preferably boiled in certain specified aqueous solutions comprising a floating agent containing ammonia, a transfer agent containing a selected phosphate or silicate aniom and a strong monovalent base. Certain ammonium salts are preferred. For example, ordinary fertilizer grade ammonium orthophosphate is surprisingly more effective than the corresponding pyrophosphate or polyphosphate. Ammonia confers a particular advantage in that it causes the separated bitumen to float on the surface of the mixture. The method of the present invention can easily be applied to either mined tar sands that are placed in a heated mixing vat, or to in situ deposits. In either case the tar layer can be floated off and handled like heavy crude oil. It is however, more economically attractive to utilize the in situ process, as described herein.

DRAWINGS

DETAILED DESCRIPTION OF THE INVENTION

Figure 1:
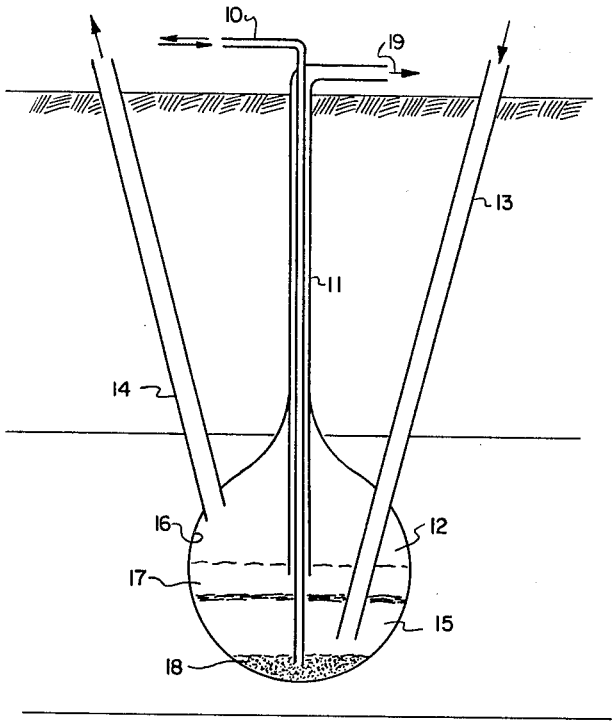
FIG. 1 is a depiction of a process for the in situ recovery of bitumen from a tar sand deposit utilizing the present invention.

When bitumen is separated from tar sand in an aqueous mixture, the important thing to note, from the standpoint of energy investment, is that the sand to bitumen bond must be broken and new surfaces formed between sand and solution and bitumen and solution. In order for such a surface exchange to proceed spontaneously it is obvious that the free energy state of the new surfaces must be lower than that of the sand to bitumen surface. Normally, when dealing with tar sand, the most practical way to lower the free energy of the system is to modify the solution in such a way as to minimize the solution to bitumen surface energy. Although, from an energy standpoint, it would be just as effective to lower the sand to solution surface energy. The simplest way to lower surface energy is to add detergents or caustic materials which convert a portion of the bitumen itself into detergent moieties. Generally the caustics are more effective in separating bitumen from tar sand than the addition of detergent. One difficulty with the caustic or detergent treatment is that, while it causes the bitumen to have more affinity for the aqueous mixture, as desired, it also causes the bitumen to exhibit more affinity for the sand surface.

A promising new approach was to search for an effective lyotropic salt. A lyotropic salt is one that increases the solubility or surface compatibility of organic materials in aqueous solutions. Most salts have the opposite effect. Examples of lyotropic ions include $Li^+$, $Na^+$, and $NH_4^+$ as cations and $Br^-$, $I^-$, $HPO_4^{--}$, $PO^{---}$ and $SiO_3^{--}$ as anions. Several lyotropic salts were tested and ammonium orthophosphate salts were found to most effectively separate bitumen from Utah tar sands even though ammonium and phosphate ions are not the best lyotropes listed above. In addition it was found that heating the aqueous mixture to a temperature of at least 40° C. and preferably to boiling was most effective in bitumen separation. It was also found that the addition of 0.1 to 5.0% of a strong monovalent base such as sodium hydroxide made the mixture more effective. Other bases which may be used include potassium hydroxide, lithium hydroxide and amino hydroxides.

Obviously the effectiveness of the ammonium phosphate mixtures was not fully explained by lyotropicity alone. There were, in fact, several unexpected advantages to the present invention. First, the bitumen in the heated solution rose to the surface of the ammonium phosphate mixture within the first few minutes of boiling without foaming or visible entrainment of bubbles in the bitumen layer. Moreover, the bitumen remained floating on the surface of the aqueous solution after cooling. Other aqueous mixtures that cause flotation generally cause foaming and will not achieve such complete extraction and flotation of the bitumen. Presumably the flotation we observed was due to the release of ammonia from the ammonium ion mixture. For this reason, for want of better terminology, ammonia or ammonium ion will be subsequently referred to as "bitumen floating agents".

Further, it was discovered that the ammonium phosphate salts were effective at relatively low concentrations between 0.1 and 20%, whereas 30% or more was expected to be required for optimal action according to lyotropic theory. The lower concentration required for optimal effectiveness (5–10%) suggests that the detergent or transfer properties of the phosphate and possibly of the ammonia contribute to the effectiveness of the observed separation. Transfer agents are effective in the transfer of sand from a bitumenous to an aqueous phase. Transfer agents can be selected from a group consisting of orthophosphate, metaphosphate and silicates. It is felt that while the lyotropic properties of the ammonium phosphate mixtures was important, the transfer properties of the phosphate was essential for the observed degree of effectiveness of the experimental mixtures.

While ammonium salts containing the phosphate and silicate anions are preferred other salts or combinations of salts which provide ammonium, phosphate or silicate ions can be used. For example a mixture of ammonium chloride and sodium orthophosphate in an aqueous solution would provide the same effects as ammonium orthophosphate. Hence ammonoum salt in general are referred to as "bitumen floating agents" and salts containing ortho and meta phosphate and silicate ions are referred to as "transfer agents".

While the above description will enable one skilled in the art to practice the invention and understand the theory upon which it is based it is not intended to be a limitation thereof nor is the invention to be limited to any particular explanation of the mechanism responsible for the benefits resulting from the application theory.

1. In situ process:

The in situ application of the present invention is shown in FIG. 1 and will apply to extraction from any tar sand deposit. However, it is most likely to apply best to strata having considerable overburden (100 to 700 meters). The overburden characterizing many tar sand deposits may make it economically unfeasible to recover bitumen without an in situ process. The process is carried out as follows. Steam and aqueous solutions of amomonium lyotropic salts and alkalinity agents are injected into the sand, through pipe (10) and vented through sleeve (11) until a small chamber (12) forms in the tar sand deposit. A second and third shaft are then drilled, a steam shaft (13) and vent (14). Superheated steam is injected through shaft (13) to boil an in situ solution (15) which is formed in developing chamber (12) in the tar sand deposit. The turbulence caused by the boiling solution (15) will erode the walls (16) of the chamber (12). This erosion is facilitated by the presence of the ammonium lyotropic salt-alkalinity agent combination. The preferred combination is fertilizer grade ammonium phosphate (5–10%) and sodium hydroxide (2%). Within chamber (12) the bitumen (17) aided by the ammonium phosphate-sodium hydroxide solution, separates from most of the sand and rises to the surface while the sand (18) falls to the bottom of the chamber. The liquified bitumen (17) containing 25–50% sand is drawn up the sleeve pipe (11) from the surface of the solution and out to receiving truck or vessel through port (19). The liquid level in the chamber is controlled by withdrawing water through pipe (10) and sand is also removed through this same pipe.

It may take some time for an in situ extraction chamber to reach a usable size, but time is not or primary importance, since the heat invested in the chamber will dissipate very slowly owing to the insulating effect of the tar sand and overburden. Many such chambers may be utilized, and the bitumen harvested from each cavern sequentially. After harvest, each chamber will soon accumulate enough bitumen to be pumped again, and so on. If desired the harvest may also be carried out continuously.

The above scheme forms a preferred embodiment; however many variations could be made that would not depart from the spirit of the invention or the scope of the appended claims. Similar chemical and steam methods can also be applied, with suitable modification, to the secondary and tertiary recovery of heavy oils.

Figure 2:
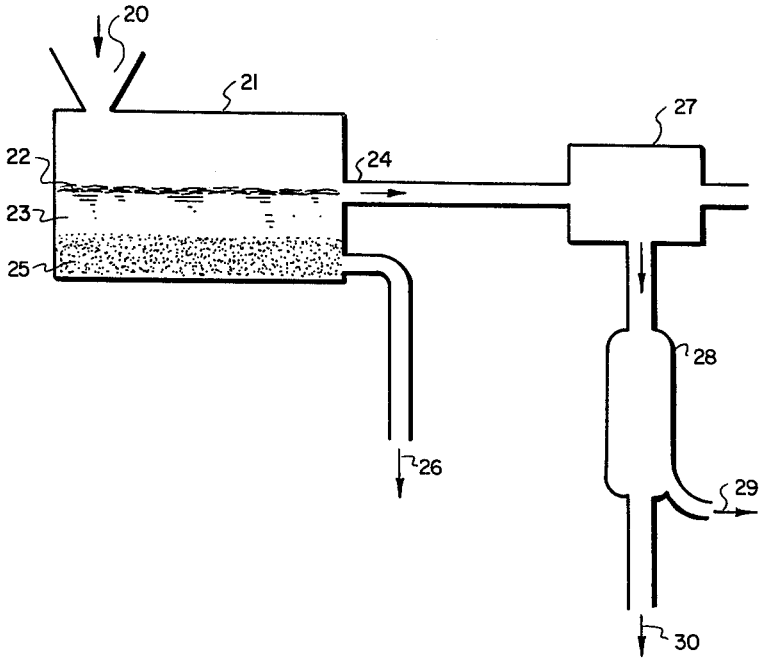
FIG. 2 is a flow diagram of a process for processing mined tar sand according to the invention.

FIG. 2 illustrates how

Bitumen may also be recovered from mined tar sands. Pulverized mined tar sand is introduced through port (20) into an extractor (21) heated by external means (not shown) and containing a heated designated ammonium salt-monovalent base solution. The bitumen (22) separates from the sand and floats on the surface of the solution (23). The floating bitumen (22) is withdrawn through port (24) and sand (25) is removed through port (26). Low density hydrocarbons (kerosene, diesel fuel, etc.) are added to the bitumen in mixing tank (27) and the resulting relatively low viscosity mixture is passed to a centrifuge (28) to remove the remaining sand and debris through port (29) and the hydrocarbon bitumen mixture is recovered through port (30).

The above scheme is also merely exemplary and many variations can be made that will not depart from the spirit of the invention or the scope of the appended claims. Unless otherwise specified, all percentages expressed herein are precent by weight.

EXAMPLE I

One hundred gram samples of tar sand obtained from an area south of Vernal, Utah, and containing 15% bitumen were placed in suitable containers. The samples were in the form of 2 to 5 cm chunks of tar sand, crumbled from larger chunks taken from the site. To each sample was added 100 ml of an aqueous mixture, as shown in Table I. Each tar sand-aqueous solution mixture was boiled for 15 minutes with the results also being repeated in Table I.

TABLE I

| Solution | Condition of Extraction Mixture After 15 Minutes of Boiling |
|---|---|
| Tap water | Unchanged except for a small amount of oil scum on the surface |
| Water plus sodium acid pyrophosphate (10%) and sodium hydroxide (2%) | 25% of the sand appeared to be cleaned, much of the tar remained with the sand |
| Water plus sodium acid orthophosphate (10%) and sodium hydroxide (2%) | Similar to the pyrophosphate |
| Water plus ammonium acid orthophosphate (10%) and sodium hydroxide (2%) | The bitumen quickly boiled to the surface. Most of the sand appeared clean and only a small amount of bitumen remained in a layer on top of the sand |

The advantage of the ammonium phosphate-sodium hydroxide mixtures is that the bitumen separation was clean and superior to the other solutions used.

EXAMPLE II

A quantitative experiment was then performed to determine the yield at various ammonium phosphate concentrations. Again, 100 g samples of the Utah tar sand as used in Example I were employed, and 100 ml ammonium phosphate solution was added using ammonium phosphate fertilizer instead of pure reagent grade ammonium phosphate. Each mixture was boiled for 5 or more minutes, cooled, and the bitumen layer was skimmed off and weighed. The bitumen was then extracted with solvent, decanted, dried, and weighed (Table II). The net bitumen yield was then calculated, based on the amount of bitumen (14.82%) that was extractable with solvent.

TABLE II

| Phosphate Fertilizer Conc. | NaOH Conc. | Wt. of sand floating in the Bitumen | Net Wt. of Bitumen | Yield of Bitumen |
|---|---|---|---|---|
| 23% | 2.1% | 9.3g | 11.5g | 77.6% |
| 10% | 2.0% | 11.8g | 11.6g | 78.3% |
| 5% | 2.0% | 3.0g | 7.0g | 47.2% |

While particular embodiments of the invention have been described herein, it will be apparent to those skilled in the art, that variations may be made therein without departing from the spirit of the invention and the scope of the appended claims.

What is claimed is:

1. A process for separating bitumen from bitumen containing formations comprising:
   (a) contacting the bitumen containing formation with an aqueous solution containing an effective amount of a floating agent, an effective amount of a transfer agent and an effective amount of a strong monovalent base at an elevated temperature causing the bitumen to separate from inorganic materials contained in said formation and
   (b) separating the bitumen from the solution.

2. A method according to claim 1 wherein the floating agent is an ammonium salt.

3. A method according to claim 2 wherein the ammonium salt is a member selected from the group consisting of dibasic ammonium orthophosphate and monobasic ammonium orthophosphate and mixtures thereof.

4. A method according to claim 3 wherein the concentration of the ammonium salt is between about 0.1 and 20%.

5. A method according to claim 4 wherein the strong monovalent base is a member selected from the group consisting of sodium, lithium, potassium and quaternary amine hydroxides having a concentration sufficient to maintain the pH of the aqueous solution at 10 or above and wherein the aqueous solution is at a temperature of from 40° C. to boiling.

6. A method according to claim 5 wherein the ammonium salt is dibasic ammonium orthophosphate and the strong monovalent base is sodium hydroxide.

7. A method according to claim 6 wherein, the bitumen containing formation is a tar sand.

8. A method according to claim 7 wherein the bitumen is separated from the tar sand in situ.

9. A method according to claim 7 wherein, the bitumen is separated from a tar sand which has been mined.

10. A method according to claim 1 wherein the transfer agent is a member selected from the group consisting of ortho and meta phosphates and silicates.

11. A method according to claim 1 wherein the strong monovalent base is a member selected from the group consisting of sodium, lithium, potassium and quaternary amine hydroxides.

12. A method according to claim 11 wherein the concentration of the strong monovalent base is sufficient to maintain the pH of the aqueous solution to 10 or above.

13. A method according to claim 1 wherein the temperature range is from 40° C. to boiling.

14. A method according to claim 13 wherein the temperature is boiling.

15. A method according to claim 1 wherein the bitumen containing formation is a heavy oil well in which the recovery of oils is applicable and wherein the bitumen separation from the formation is carried out in situ.

16. A method according to claim 1 wherein the bitumen containing formation is an oil well in which the secondary or tertiary recovery of oil is applicable and wherein the bitumen separation from the formation is carried out in situ.

17. A method for the in situ separation of bitumen from a tar sand deposit which comprises:
   (a) injecting concurrently into the tar sand deposit steam and a heated aqueous solution containing effective amounts of (1) a floating agent, (2) a transfer agent and (3) a strong monovalent base
   (b) causing said steam and aqueous solution to liquify a portion of the tar sand deposit forming an in situ chamber containing the aqueous solution in which bitumen separates from the tar sand in the aqueous solution and
   (c) separating bitumen from the aqueous solution.

18. A method according to claim 17 in which steam and aqueous solution are added continuously and bitumen is continuously withdrawn.

* * * * *